US007052157B1

(12) United States Patent
Lau

(10) Patent No.: US 7,052,157 B1
(45) Date of Patent: May 30, 2006

(54) MULTI-FUNCTION LUMINAIRE

(76) Inventor: Kenneth H. Lau, 4327 Point Reyes Ct., Carlsbad, CA (US) 92008

( * ) Notice: Subject to any disclaimer, the term of this patent is extended or adjusted under 35 U.S.C. 154(b) by 163 days.

(21) Appl. No.: 10/831,905

(22) Filed: Apr. 26, 2004

Related U.S. Application Data

(60) Provisional application No. 60/465,729, filed on Apr. 26, 2003.

(51) Int. Cl.
*F21K 2/00* (2006.01)

(52) U.S. Cl. ..... 362/216; 362/260; 362/414; 362/225; 362/361; 362/360

(58) Field of Classification Search ..... 362/216, 362/225, 249, 235, 410, 414, 351, 252, 353, 362/360, 361
See application file for complete search history.

(56) References Cited

U.S. PATENT DOCUMENTS 2,441,399 A * 5/1948 De Reamer et al. ..... 362/228
2,454,243 A * 11/1948 Wiedenhoeft ..... 362/216
2,507,074 A * 5/1950 Wiedenhoeft ..... 362/216
6,398,384 B1 * 6/2002 Siminovitch et al. ..... 362/225
2005/0201082 A1 * 9/2005 Mauk et al. ..... 362/147

* cited by examiner

*Primary Examiner*—Thomas M. Sember
(74) *Attorney, Agent, or Firm*—Charles C. Logan, II

(57) ABSTRACT

A multiple function lighting fixture that uses compact fluorescent lamps (CFL), and circular fluorescent lamps positioned in strategic locations inside a lampshade. A shield within the lampshade divides the area into a primary interior zone and a secondary interior zone. One of the respective lamps is located in each of the respective interior zones. One of the lamps provides for upwardly directed light and the other lamp provides downwardly directed light. The inner and outer surfaces of the shield may have reflective properties. The lampshade may have portions thereof having light transmitting properties. The inner surface of the lampshade may have reflective properties in some areas. LEDs may be mounted in various areas of the respective primary interior zone and secondary interior zones. The light fixture may also have dimmer control switches/sensors and there may be sensors for remote control operation for turning the respective lamps on and off.

12 Claims, 4 Drawing Sheets

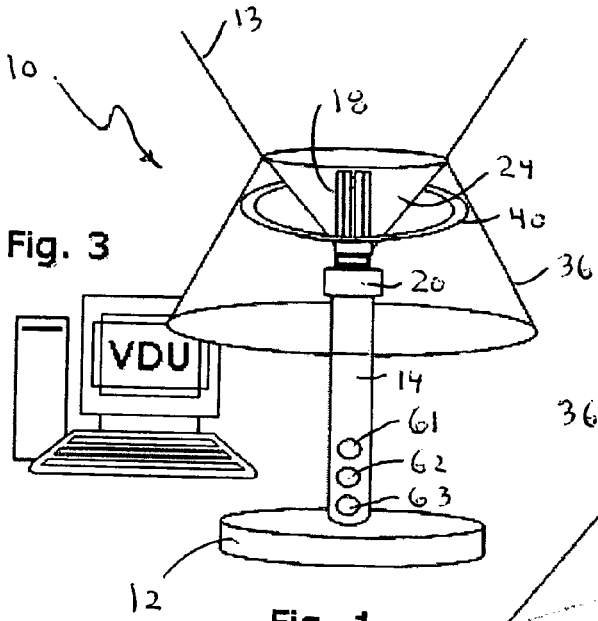
Fig. 3
Fig. 1
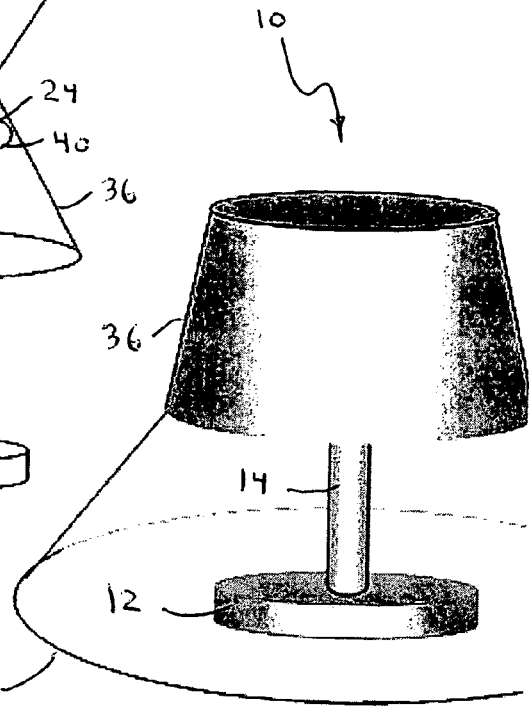
Fig. 2

MULTI-FUNCTION LUMINAIRE

This patent application claims the priority of U.S. Provisional Patent Application. No. 60/365,729 filed Apr. 26, 2003.

BACKGROUND OF THE INVENTION

Architects and interior designers are reluctant to use CFL's or. Circline lamps in their designs for residential applications because they relate fluorescent lamps to poor color rendition and low quality status as compared to halogen and incandescent lamps. Dimming is also an important feature to have in residential lighting. The CFL and. Circline are difficult to dim as they need special electronic ballasts and dimmers unlike incandescent and halogen lamps which do not. Present day Internet households further cause more fixture design challenges for use with computer screens, TV monitors, Video. Display. Units (VDU's) and other visual tasks.

It is an object of the invention to provide a novel multi-function lighting fixture using various types of energy efficient lamps.

It is another object of the invention to provide a novel multi-function lighting fixture that will provide a full range of visual tasks as an Up-light, a Down-light, a Night Light or a combination of all three functions when fully lit within its unique double cone lampshade.

It is another object of the invention to provide a novel multi-function lighting fixture that can be made as a floor lighting fixture, a table lamp or task lighting fixture or as a wall sconce fixture.

SUMMARY OF THE INVENTION

The multi-function, multi-head lighting fixture will have the following features: instant on CFL and Circline dimmable features utilizing the latest energy saving CFL technology. CFL lamp life is 12,000 hours compared to incandescent lamp life of 750 hours. CFL lamps also last 16 times longer than incandescent lamps. Lamp color temperature is 2700 Kelvin CRI with a CRI of approximately 82 which gives warm color and excellent color rendition. The CFL will be driven by electronic ballast which only weigh a fraction of the old core coil ballast and it is available in miniature sizes to fit into the limited housing space. LED's will have their own power supply within the fixture housing.

High wattage CFL and Circline lamps with dimmable controls will be used with the lighting fixture to cope with the wide range of visual tasks and lighting demands. One 57 W CFL or Circline lamp used with this fixture equals one 300 W incandescent lamp. The CFL and Circline lamps operate much cooler than the incandescent or halogen lamps while consuming only 19% energy while providing the same 33 W light output. Both the CFL and Circline lamps are much safer than the halogen lamp which is a fire hazard when used near anything flammable.

DESCRIPTION OF THE DRAWINGS

FIG. 1 is a schematic side elevation view of the novel multi-function lighting fixture depicting upwardly directed light rays;

FIG. 2 is a schematic side elevation view of the novel multi-function lighting fixture depicting downwardly directed light rays;

FIG. 3 represents a visual display unit (VDU) that benefits from having a lighting fixture in the room;

DESCRIPTION OF THE PREFERRED EMBODIMENT

Figure 4:
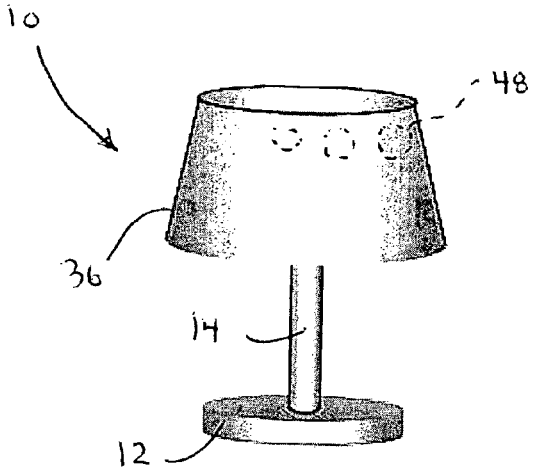
FIG. 4 is a side elevation view of the novel multi-function lighting fixture showing the fixture shade lit by multi-color LEDs.
Figure 5:
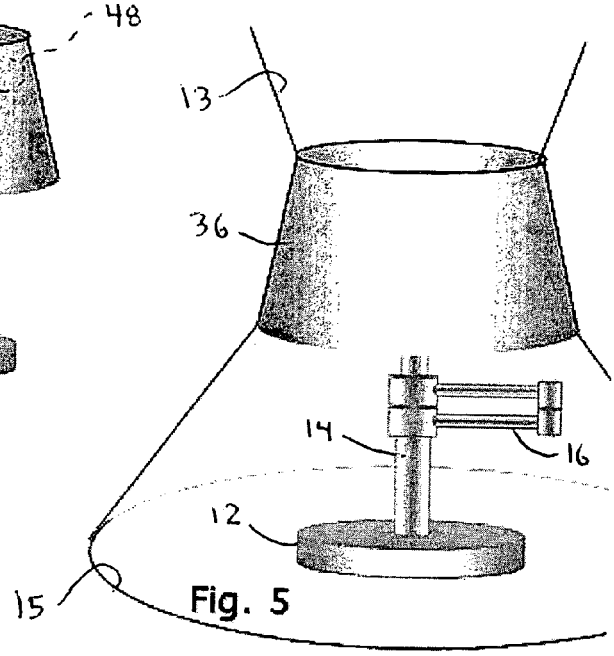
FIG. 5 is a side elevation illustrating a fully light multi-function lighting fixture showing the upwardly directed CFL beam, a downwardly directed Circline beam, and the fixture shade lit by multi-color LEDs'

A first multi-function lighting fixture will now be described by referring to FIGS. 1–7 of the drawings. The lighting fixture is generally designated numeral 10. It has a base 12 and a post member 14 that function as support structure for a lamp such as a CFL lamp. FIG. 5 illustrates that the post member 14 may have a flexible arm assembly 16. FIG. 1 shows the upwardly directed light beam 13 and FIG. 2 shows the downwardly directed light beam 15.

The CFL lamp 18 is detachably threaded into electrical socket 20 mounted on post member 14. An inverted cone shaped shield 24 has a top edge 26 and a bottom edge 28. Top edge 26 has a width W1 and bottom edge 28 has a width W2. Shield 24 would normally be made of opaque material and preferably has a reflective inner surface and a reflective outer surface. The outer surface of shield 24 may have predetermined areas having non-reflective or baffle members 30 to provide light beam control. The shield 24 defines an interior zone 25 in which the CFL is located. The shade 36 has a top edge having a width W3 and a bottom edge having a width W4. The shade may be made of light transmissible material. It may also be made of opaque material that is either non-reflective or reflective, or it may have predetermined areas that transmit light. Non-reflective baffles 30 would be positioned at predetermined areas on the inner surface of shade 36. The shade 36 has an interior zone 25 within which is mounted a circular fluorescent lamp 40. This lamp may be attached to the outer surface of shield 24 by mounting clips 42. A reflector 44 may be an annular ring and it is mounted above the circular fluorescent lamp 40 to direct its upwardly directed light rays downwardly. A chamber 46 is located above the respective reflector 44 and LEDs 48 may be mounted therein. The portion of the shade 36 adjacent the LEDs would be made of light transmitting material or have light transmitting portions. A ballast for circular flourescent lamp 40 can be mounted in base 12.

Figure 6:
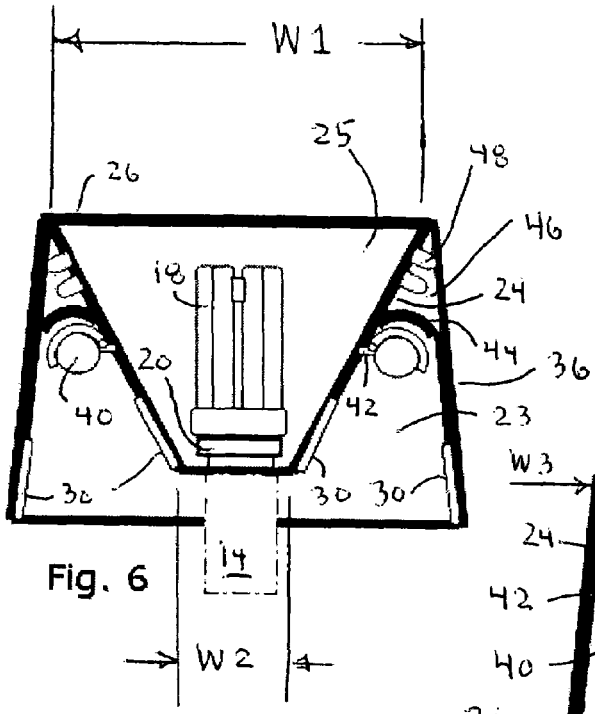
FIG. 6 is a schematic cross sectional view of a first embodiment of the multi-function lighting fixture.
Figure 7:
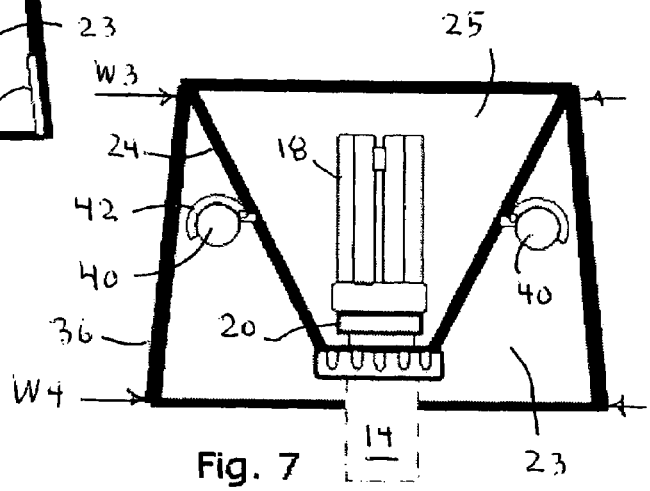
FIG. 7 is a schematic cross sectional view of a variation of said first embodiment of the multi-function lighting fixture.

The multi-function lighting fixture serves a full range of visual tasks. The lighting fixture may be operated with a CFL 18, a circular fluorescent lamp 40 and LEDs 48 all turned on at one time. Each could have their respective switch 61, 62 and 63 for turning the respective lamps on or off or dimming them. These switches could also have a sensor so that the operation of the lamps could be accomplished by remote control. Rather than having all of the lamps operating at one time, any combination can be used such as only two of the lamps or one of the lamps lit at one time. The multi-function lighting fixture can be used as a night light by using only the LEDs 48. The multi-function lighting fixture can take the form of a table lamp, a task lighting fixture, a wall sconce, or any desirable structure. A cross section illustrated in FIG. 6 shows a combined structure of the shade 36 and shield 24 having the configuration of the letter "M". The lighting fixture could be operated through remote control, or by wall or manual switches. FIG. 3 shows a radio display unit (VDU). The multi-function lighting fixture would be used in the background or adjacent thereto to provide visual comfort. The circular flourescent lamp is well concealed in its own domain and not visible to the user due to its recessed position inside the shade which prevents glare. Interior baffles 30 can also be installed to cut off light and provide beam control. The shield 18 can be made of metal and used as a heat sink for LEDs. The LEDs are used in their special niches to provide mood or night light functions. The shade can be made of translucent material that would act as a diffuser for the LEDs which could be white or muti-colored to create soothing effects. The singular use of the fluorescent lamp 40 enables a person reading in bed not to disturb another sleeper because of the shade beam cut-off feature.

Figure 8:
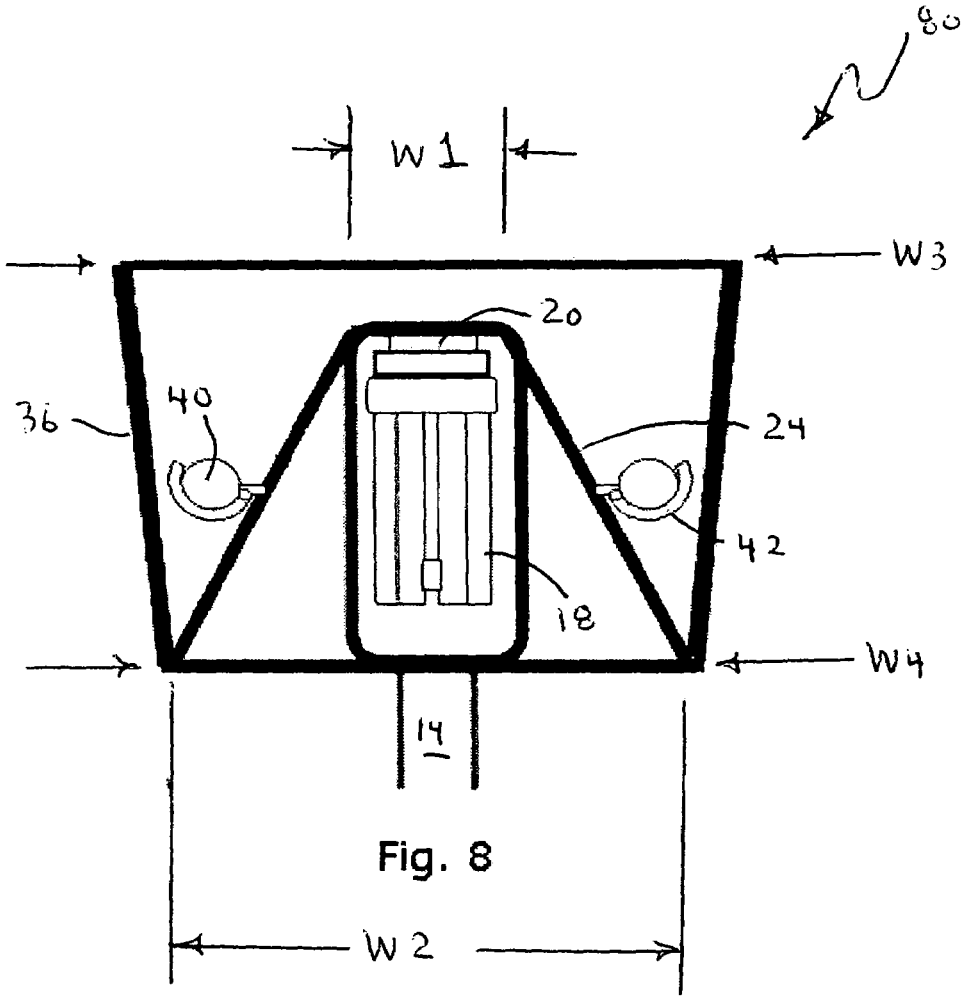
FIG. 8 is a schematic cross sectional view of a second embodiment of the multi-functional lighting fixture.

An alternative embodiment of the multi-function lighting fixture is illustrated in FIG. 8. The reference numerals utilized in describing the previous multi-function lighting fixture would identify like structure in this embodiment. This lighting fixture is designated numeral 80. The cross section in this figure has the general configuration of the letter "W". CFL 18 can be mounted upside down or right side up as desired. In its presently illustrated form the harp 82 would be connected to the socket 20.

The invention claimed is:

1. A lighting fixture comprising:

a lamp support structure;

at least one electrical socket mounted on said lamp support structure;

a convex configured shield having a top edge, a bottom edge, an inner surface, a secondary interior zone and an outer surface; said top edge having a width W1; said bottom edge having a width W2; W2 is greater than W1;

means supporting said shield;

a compact fluorescent lamp (CFL) having a top end, and a bottom base end; said bottom base end being detachably connected to said at least one electrical socket; said CFL being located in said secondary interior zone of said convex configured shield to provide downwardly directed light;

a shade having a top end, a bottom end, an inner surface, an outer surface, a primary interior zone; said top end having a width W3; said bottom end having a width W4;

a circular fluorescent lamp being located in said primary interior zone of said shade to provide upwardly directed light; said circular fluorescent lamp being electrically connected to a ballast; and means for supporting said circular lamp.

2. A lighting fixture as recited in claim 1 wherein said convex configured shield has a cone shape.

3. A lighting fixture as recited in claim 1 wherein said inner surface of said convex configured shield has reflective properties.

4. A lighting fixture as recited in claim 1 wherein said outer surface of said convex configured shield has reflective properties.

5. A lighting fixture as recited in claim 1 wherein said inner surface of said shade has reflective properties.

6. A lighting fixture as recited in claim 1 wherein said lamp support structure is a post member having a bottom end; a base member is connected to said bottom end.

7. A lighting fixture as recited in claim 6 wherein a ballast for said circular fluorescent lamp is in said base member.

8. A lighting fixture as recited in claim 1 further comprising a dimmer control switch connected to at least one of said fluorescent lamps.

9. A lighting fixture as recited in claim 1 further comprising a remote control sensor connected to at least one of said fluorescent lamps.

10. A lighting fixture as recited in claim 1 wherein predetermined portions of said shade have properties that allow light to pass through.

11. A lighting fixture as recited in claim 10 further comprising a plurality of LED's positioned in said primary interior zone of said shade adjacent said predetermined portions.

12. A lighting fixture as recited in claim 1 further comprising an auxiliary reflector member mounted in said primary interior zone below said circular fluorescent lamp to reflect light upwardly.

* * * * *